US006489546B2

(12) United States Patent
Enhoffer et al.

(10) Patent No.: US 6,489,546 B2
(45) Date of Patent: Dec. 3, 2002

(54) MUSICAL INSTRUMENT AND METHOD OF MAKING SAME

(75) Inventors: Raymond Enhoffer, Clifton, NJ (US); Richard Simons, Garfield, NJ (US); Andrzej Krol, Lincoln Park, NJ (US)

(73) Assignee: Latin Percussion, Inc., Garfield, NJ (US)

( * ) Notice: Subject to any disclaimer, the term of this patent is extended or adjusted under 35 U.S.C. 154(b) by 0 days.

(21) Appl. No.: 09/764,482

(22) Filed: Jan. 17, 2001

(65) Prior Publication Data

US 2002/0092405 A1 Jul. 18, 2002

(51) Int. Cl.[7] ..... G10D 13/08

(52) U.S. Cl. ..... 84/406; 84/402; 84/404; 84/410

(58) Field of Search ..... 84/406, 402, 404, 84/410

(56) References Cited

U.S. PATENT DOCUMENTS

| | | | | |
|---|---|---|---|---|
| 4,362,080 A | | 12/1982 | DeArmas | 84/406 |
| 4,981,065 A | | 1/1991 | Cohen | 84/402 |
| 5,505,114 A | * | 4/1996 | Lawson | 84/404 |
| 6,255,572 B1 | * | 7/2001 | Moghaddam et al. | 84/402 |

* cited by examiner

*Primary Examiner*—Shih-Yung Hsieh
(74) *Attorney, Agent, or Firm*—Ohlandt, Greeley Ruggiero & Perle LLP

(57) ABSTRACT

There is provided a musical instrument according to the present invention having body wall with a single welded seam on the underside opposite the striking or playing side. This construction method allows for a vibrating surface of continuing proportions producing a sound that is very articulate, yet retains a nice balance of overtones. In addition, there is a cost savings in manufacturing musical instruments according to the present invention. The musical instruments of the present invention are also more durable.

20 Claims, 2 Drawing Sheets

MUSICAL INSTRUMENT AND METHOD OF MAKING SAME

BACKGROUND OF THE INVENTION

1. Field of the Invention

The present invention generally relates to musical instruments. In particular, the present invention relates to percussion instruments, such as cowbells, and, more particularly, to methods of making such percussion instruments.

2. Background of the Invention

Cowbells and similar musical instrument are typically made using a clamshell design with two sections welded together along mating side surfaces. For example, U.S. Pat. No. 4,362,080 to DeArmas issued on Dec. 7, 1982 for a Staccato Cowbell. This patent states that, although the sounding chamber may, if desired, be formed from a single piece of material, for ease of construction it may be constructed with the sides of the chamber being constructed of hemi-oval sections.

This traditional construction has several drawbacks. For example, the welded seams have a tendency to crack over time. Thus, a cowbell with fewer welds would be more durable. In addition, welding is a relatively time consuming and expensive technique. A cowbell with fewer welds would be more economical to produce.

More importantly, the welds along the side surfaces have a profound effect on the overall sound of the cowbell. For example, cowbells made with tack welds are dry in sound character. On the other hand, cowbells made with fully welded seams produce sound rich in overtones, but lack some articulation.

SUMMARY OF THE INVENTION

It is an object of the present invention to provide a cowbell or other similar instrument with an improved sound quality.

It is also an object of the present invention to provide such a musical instrument that is durable and inexpensive to produce.

It is yet an object of the present invention to provide such a musical instrument that has body wall with a single longitudinal seam.

It is a further object of the present invention to provide a method of making cowbells and other similar instruments.

These and other objects of the present invention are achieved by a musical instrument according to the present invention having a body wall with a single welded seam on the underside opposite the striking or playing side. This instrument allows for a vibrating surface of continuing proportions producing a sound that is very articulate, yet retains a nice balance of overtones. In addition, there is a cost savings in manufacturing musical instruments according to the present invention. The musical instruments of the present invention are also more durable.

DETAILED DESCRIPTION OF THE INVENTION

Figure 2:
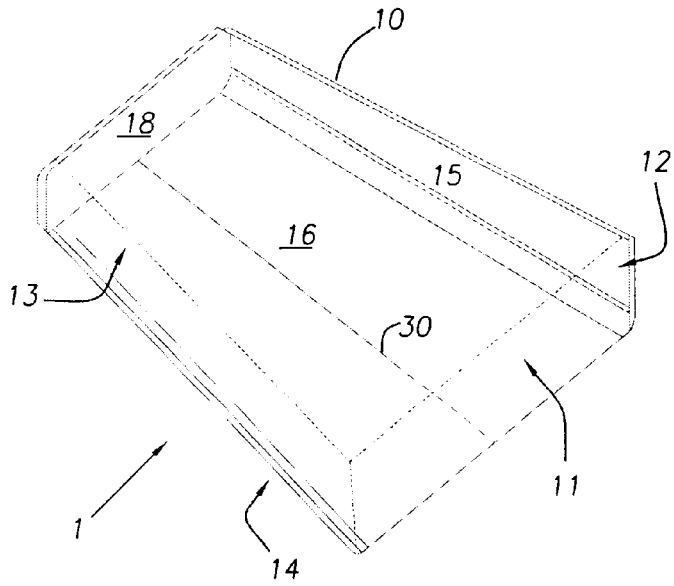
FIG. 2 is a musical instrument according to the present invention.

Referring to the drawings and, in particular, FIG. 2, there is provided a musical instrument according to the present invention, generally represented by reference number 1. As shown, musical instrument 1 is a cowbell. However, the present invention provides for any percussion instrument having the features described herein.

Figure 1:
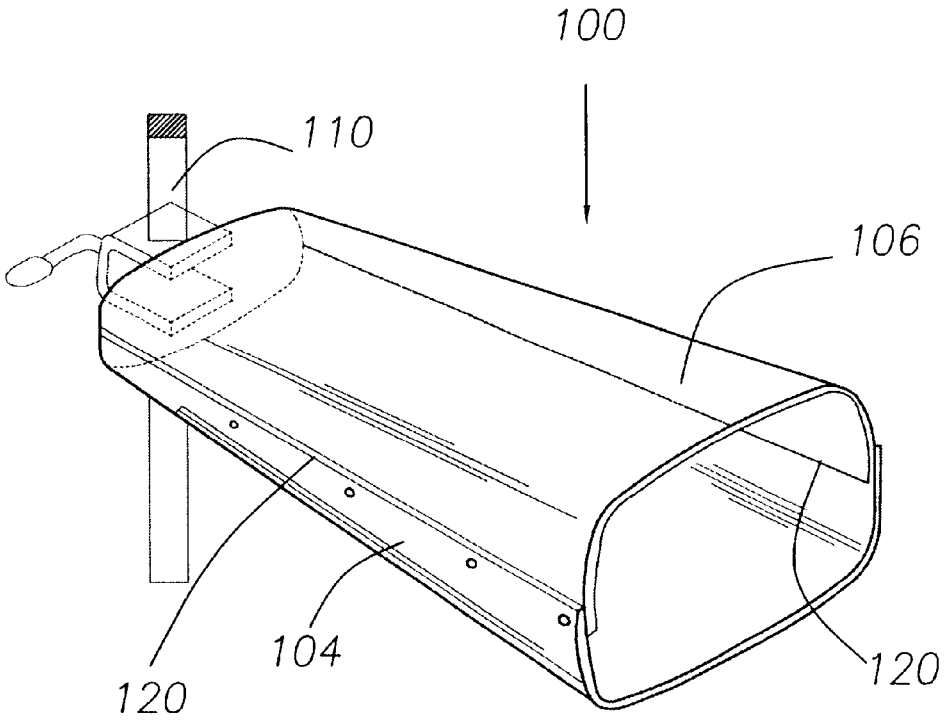
Prior Art FIG. 1
FIG. 1 is a prior art cowbell.

Referring to FIG. 1, a conventional cowbell 100 is secured at its close end to a post 110. The cowbell is two pieces 104, 106 of material that are folded into a basically four-sided structure. The two pieces are secured together along two seam lines 120. The seam lines are positioned along the shorter sides of the cowbell.

Figure 3:
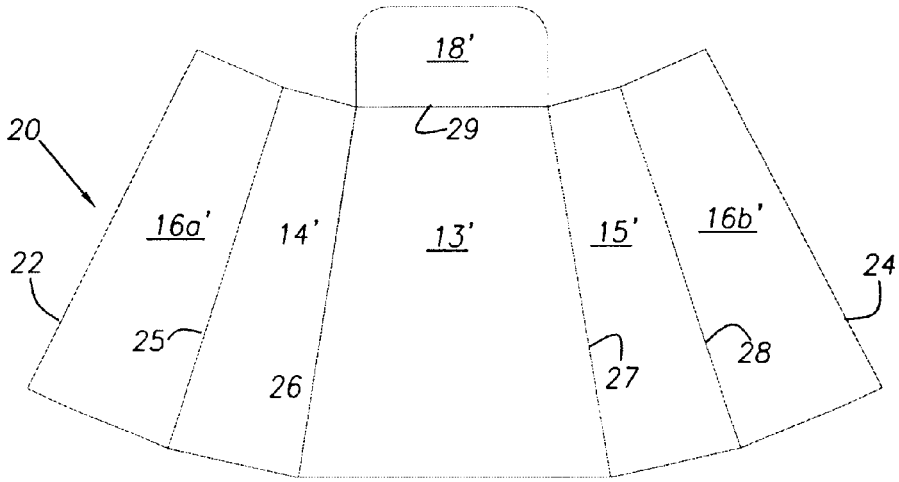
FIG. 3 is a form that is folded to make the musical instrument of FIG. 2.

The musical instrument 1 according to the present invention is shown in FIGS. 2 and 3. Musical instrument 1 has a body wall 10 with an open end 12 and an end wall 18, preferably opposite the open end. End wall 18 may be integrally formed with body wall 10 or, instead, may be a separately formed piece that is subsequently attached and/or welded to body wall 10.

Body wall 10, especially with end wall 18, defines a sounding chamber 11. Body wall 10 has several wall segments. Each adjacent pair of segments is connected together by a seam or fold line. The number of wall segments are preferably equal in number. Also preferably, body wall 10 has at least four wall segments 13 to 16. Each wall segment 13 to 16 is preferably trapezoidal in shape. In addition, it is preferred that opposing side segments 14 and 15 have a smaller area as compared to top segment 13 and opposed bottom segment 16. It is also preferred that segments 13 and 16, and likewise segments 14 and 15, have the same shape or configuration.

Accordingly, musical instrument 1 preferably has a generally rectangular cross-sectional shape and a cross-sectional area that gradually increases from end segment 18 to open end 12.

In accordance with the present invention, musical instrument 1 has a single seam 30 in body wall 10 along bottom segment 16. Seam 30 is preferably positioned along the center of segment 16. Seam 30 may be sealed using as suitable technique. Preferably, when body wall 10 is made of a metal, seam 30 is welded. Alternatively, seam 30 may be tacked at a plurality of points along its length or completely sealed along its entire length depending upon the desired sound and aesthetics of musical instrument 1.

It has been discovered that a musical instrument, as described above, having a single seam along the bottom segment thereof has improved sound quality as compared to such musical instruments having two or more seams along side surfaces thereof as shown in the prior art FIG. 1. In particular, a cowbell having a single welded seam along the center line of the bottom wall thereof, as provided by the present invention, allows for a vibrating surface of continuing proportions, which produces a sound that is very articulate, yet retains a desirable balance of overtones. This is particularly achieved if the seam is welded. It is believed that a musical instrument according to the present invention vibrates in a freer manner compared to traditional designs. Moreover, musical instrument 1 according to the present invention is more durable and economical to produce compared to similar musical instruments have two or more seams along side surfaces thereof.

Optionally, sounding chamber 11 may be divided into a plurality of sections (not shown). Also optionally, musical instrument 1 may have a connecting member (not shown) for attaching the musical instrument to a stand, a handle, or a similar device.

The various parts of musical instrument 1 may be formed using any suitably material. Musical instrument 1 is made of a suitably rigid material that will not become distorted during playing. On the other hand, materials used to make musical instrument 1 must become malleable or pliable under predictable circumstances so that the materials can be shaped into musical instrument 1. For example, materials useful for making musical instrument 1 include metal, wood, plastic, or any combination thereof. Body wall 10 is made of a material selected from the group consisting of metal, wood, plastic, and any combination thereof. Body wall 10 is more preferably formed of a metal, such as brass, steel, and/or aluminum.

Referring to FIG. 3, musical instrument 1 is made from a single form 20. Form 20 has five contiguous segments 13' to 15', 16*a*', and 16*b*' separated by four boundaries 25 to 28. Boundaries 25 to 28 are folded to form body wall 10. When form 20 is folded along boundaries 25 to 28, central segment 13' becomes top wall 13. Segments 14' and 15' become opposing side walls 14 and 15. To form bottom wall 16, edges 22 and 24 of respective segments 16*a*' and 16*b*' are placed in proximity to one another (e.g., side by side or overlapping) and attached together, preferably by welding. A back segment 18' may be integrally joined to form 20 at a boundary 29. If this is the case, boundary 29 is folded so that back segment 18' becomes back wall 18. In an alternative embodiment, back segment 18' may be separately attached to body wall 10 to from back wall 18 after edges 22 and 24 have been attached together.

Musical instrument 1 is played by striking a segment of body wall 10. Most preferably, top segment 13, and less preferably segments 14 and 15, are struck to play musical instrument 1.

The foregoing description is directed to a four sided, bell-shaped musical instrument, such as a cowbell. However, a musical instrument according to the present invention may have only three sides or more than four sides. It is preferred, however, that musical instrument 1 have an even number of sides or surfaces. In addition, the bending radius and side angles of the folds in musical instrument 1 depend on the desired overall shape and size of such a musical instrument.

The present invention having been thus described with particular reference to the preferred forms thereof, it will be obvious that various changes and modifications may be made therein without departing from the spirit and scope of the present invention.

What is claimed is:

1. A musical instrument comprising:

a body wall having a first surface upon which said body wall is struck to produce a sound, and a second surface opposite said first surface and having a single, closed seam therein, said seam being the only seam in said body wall, said body wall having an open end and having an end wall opposite said open end, said body wall defining a sounding chamber, whereby the musical instrument has an articulate sound and retains a desirable balance of overtones when struck.

2. The musical instrument of claim 1, wherein said seam is positioned in a center of said second surface.

3. The musical instrument of claim 2, wherein said seam is a welded seam.

4. The musical instrument of claim 1, wherein said body wall further comprises a third surface and a fourth surface.

5. The musical instrument of claim 4, wherein said third surface and said fourth surface are opposite each other.

6. The musical instrument of claim 4, wherein said third surface and said fourth surface are opposite each other and virtually perpendicular to said first and said second surfaces.

7. The musical instrument of claim 1, wherein said body wall is made of a metal.

8. The musical instrument of claim 1, wherein said seam is a welded seam.

9. The musical instrument of claim 1, wherein the musical instrument is a cowbell.

10. The musical instrument of claim 1, wherein said end wall is welded to said body wall.

11. The musical instrument of claim 1, wherein said body wall is made of a material selected from the group consisting of metal, wood, plastic, and any combination thereof.

12. A method of making a musical instrument comprising the steps of:

folding a form having two edges and a plurality of segments separated from one another by foldable boundaries so that said two edges are in proximity to one another;

connecting said two edges to form a body wall having only one seam therein;

attaching an end segment to said body wall to define a closed end, whereby the resultant musical instrument has a body wall having a first surface upon which said body wall is struck to produce a sound, and a second surface opposite said first surface having a single seam therein, said seam being the only seam in said body wall, whereby the musical instrument has an articulate sound and retains a desirable balance of overtones when struck.

13. The method of claim 12, wherein said step of connecting said two edges is by welding.

14. The method of claim 12, wherein said step of connecting said two edges is by tacking.

15. The method of claim 12, wherein said step of connecting said two edges is by tacking said two edges at a plurality of points along said two edges.

16. The method of claim 12, wherein said step of attaching is by welding.

17. The method of claim 12, wherein said body wall further comprises a third surface and a fourth surface.

18. The method of claim 17, wherein said third surface and said fourth surface are opposite each other.

19. The method of claim 17, wherein said third surface and said fourth surface are opposite each other and virtually perpendicular to said first and said second surfaces.

20. The method of claim 12, wherein said body wall is made of a metal.

* * * * *